United States Patent [19]

Cadman

[11] 3,985,148

[45] Oct. 12, 1976

[54] CRUTCH CARRY-ALL ATTACHMENT

[76] Inventor: Phillip B. Cadman, 9206 Chestwall St., Orangevale, Calif. 95662

[22] Filed: Oct. 15, 1975

[21] Appl. No.: 622,505

[52] U.S. Cl. ..... 135/66; 248/293; 248/311.1; 248/441 B

[51] Int. Cl.[2] ..... A45B 1/00

[58] Field of Search ..... 135/47, 49; 248/238, 248/291, 293, 311 R, 312, 441 B

[56] References Cited

UNITED STATES PATENTS

| | | | |
|---|---|---|---|
| 882,854 | 3/1908 | Weaver | 248/311 R |
| 917,914 | 4/1909 | Otteren | 248/312 |
| 1,181,942 | 5/1916 | Underwood | 248/312 |
| 1,611,550 | 12/1926 | Moss | 248/312 |
| 2,553,730 | 5/1951 | Taylor | 135/47 |

*Primary Examiner*—Werner H. Schroeder
*Assistant Examiner*—Conrad L. Berman
*Attorney, Agent, or Firm*—Blair & Brown

[57] ABSTRACT

A crutch carry-all attachment for holding letters, papers, books and magazines, including a compartment having a flat side detachably secured to a crutch and the opposite side hinged on a horizontal pivot, so that it can drop into a horizontal position. The side that drops has an opening formed therein for holding a cup such as is used for beverages. Magnets on the crutch help to secure the attachment in place, holding the hinged side in closed position when this is desired, and the flat side as well.

5 Claims, 5 Drawing Figures

FIG. 1.
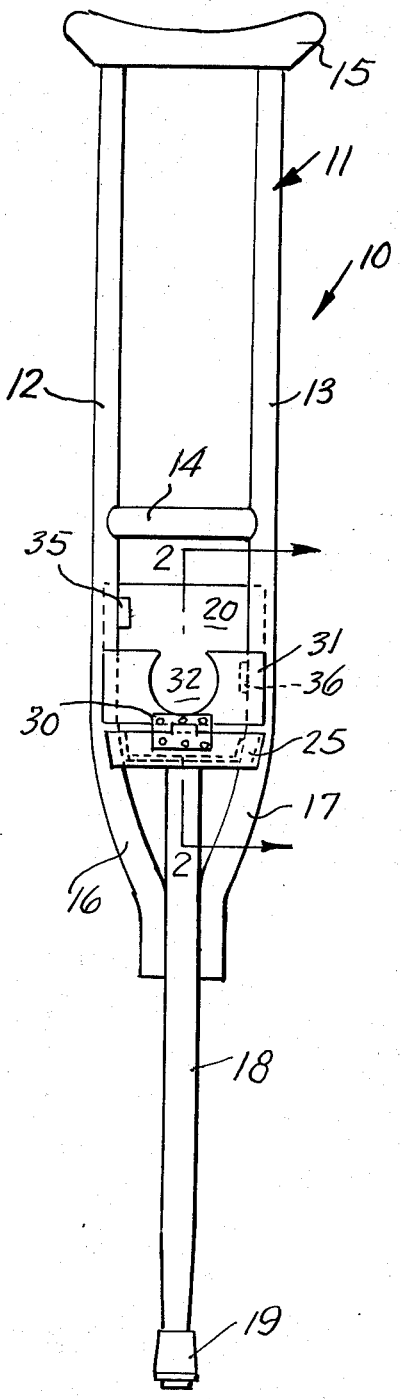
FIG. 2.
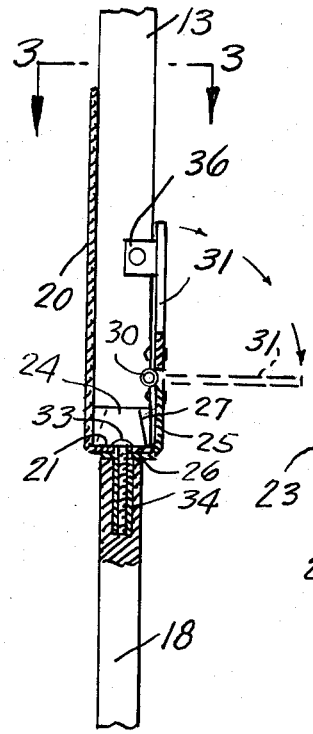
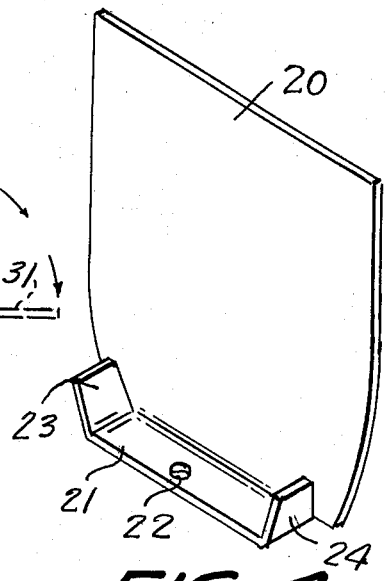
FIG. 4.
FIG. 3.
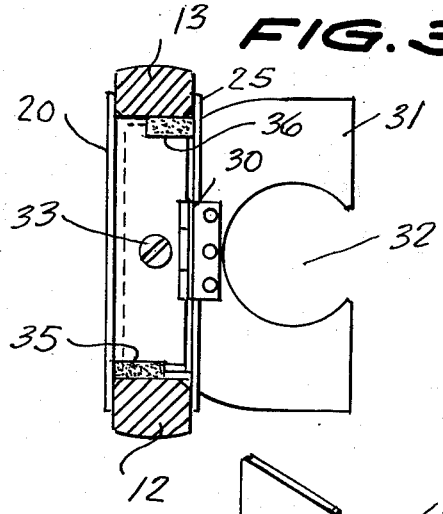
FIG. 5.
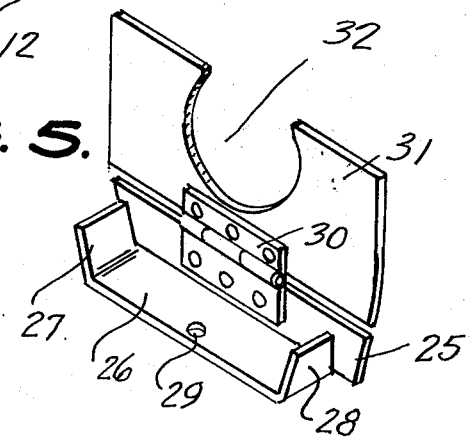

CRUTCH CARRY-ALL ATTACHMENT

BACKGROUND OF THE INVENTION

FIELD OF THE INVENTION

The present invention relates to crutch carry-alls for providing a convenient compartment for handicapped users of the crutch.

SUMMARY OF THE INVENTION

A relatively thin compartment is secured in place between the side supports of a crutch with one side of the compartment being hinged along a horizontal pivot so that it can be lowered to a horizontal position. Magnets on the crutch assist in holding the compartment in place and support the hinged side in closed position.

The primary object of the invention is to provide a compartment which can be attached to a crutch for holding articles in a convenient position to the crutch user.

Other objects and advantages will become apparent in the following specification when considered in light of the attached drawings.

BRIEF DESCRIPTION OF THE DRAWINGS

FIG. 1 is a front elevation of the invention;

FIG. 2 is an enlarged fragmentary vertical sectional view taken along the line 2—2 of FIG. 1 looking in the direction of the arrows;

FIG. 3 is a transverse sectional view taken along the line 3—3 of FIG. 2 looking in the direction of the arrows;

FIG. 4 is a perspective view of one of the side panels removed from the crutch; and FIG. 5 is a perspective view of the other side of the compartment removed from the crutch.

DESCRIPTION OF THE PREFERRED EMBODIMENT

Referring now to the drawings in detail wherein like reference characters indicate like parts throughout the several Figures, the reference numeral 10 indicates generally a crutch carry-all constructed in accordance with the invention.

The crutch carry-all 10 is adapted for use with a crutch 11 having a pair of side rails 12–13, a handle 14 extending between and secured to the side rails 12–13 and a padded support 15 for engagement in the armpit of the user. The side rails 12–13 converge inwardly at 16–17 to engage the leg 18 which is secured therebetween. A crutch tip 19 is positioned on the lower end of the leg 18 to absorb some of the shock of use of the crutch as well as provide an anti-slip contact with the ground. The crutch 11 is of conventional design and may vary in accordance with the needs of the users.

A side panel 20 covers one side of the crutch carry-all attachment for the crutch 11 and includes a bottom flange 21 extending perpendicularly to the panel 20 and having a bore 22 centrally thereof. A pair of ears 23–24 are formed integrally with the bottom flange 21 and extend upwardly and slope outwardly to engage the tapering portion 16–17 of the side rails 12–13. A somewhat shorter second side panel 25 is provided with an inwardly projecting flange 26 arranged perpendicularly to the side panel 25. A pair of ears 27–28 on the flange 26 are adapted for engagement with the tapering portions 16–17 of the side rails 12–13. A bore 29 centrally positioned on the flange 26 is adapted to register with the bore 22 of the flange 21 when attached to a crutch. A hinge 30 on the second side panel 25 is secured to a door panel 31 with the door panel 31 having a central opening 32 formed therein for reasons to be assigned. A bolt 33 extends downwardly through the bore 22 through the bore 29 into a threaded socket 34 in the upper end of the leg 18. The bolt 33 secures the flanges 21 and 26 in place on the leg 18 with the side panels 20–31 engaging the opposite sides of the side rails 12–13. It should be noted that the flanges 21 and 26 are somewhat shorter than the side panels 20–25 to permit the side panels 20–25 to engage the opposite faces of the side rails 12–13 as can be clearly seen in FIG. 3.

A magnet 35 is secured to the rail 12 in a position to be contacted by the side panel 20 adjacent the upper end thereof so as to assist in securing the side panel 20 to the side rail 12.

A magnet 36 is secured to the side rail 13 to hold the panel 31 in upright position when the compartment is closed.

In the use and operation of the invention the carry-all is secured in place on the crutch 10 with the bolt 33 and the two magnets 35–36 are secured to the side rails 12–13 respectively so as to help secure the compartment 10 in place.

With the side panel 31 in raised position, a considerable quantity of material can be positioned between the side panels 20–25 and the raised panel 31 at a position convenient to the user of the crutch. In order to gain easier access to the compartment, the panel 31 can be hinged downwardly to a horizontal position, as illustrated in FIG. 3, and while in this position can be used to support a cup in the opening 32. When desired, the panel 31 can be used in its lower position to support the underside of a relatively heavy object which is supported then by the fingers of the user of the crutch at the upper end thereof.

It should be understood that the particular shape and size of the carry-all compartment can be changed as needed to suit the needs of the user.

Having thus described the preferred embodiment of the invention it should be understood that numerous structural modifications and adaptations may be resorted to without departing from the spirit of the invention.

What is claimed is:

1. A crutch carry-all for attachment to a crutch of the type having a pair of spaced apart side rails and a leg secured therebetween and extending downwardly therefrom comprising a side panel including a bottom flange extending perpendicularly inwardly therefrom and adapted to be placed between the spaced apart side rails, a second, spaced, relatively short side panel having a flange extending perpendicularly inwardly therefrom with said flanges arranged in horizontal overlapping position and adapted to be placed between the spaced apart side rails, means extending through said flanges for detachably securing said flanges of said side panel and said short side panel to the leg of the crutch, a hinged side panel pivotally secured to said short side panel and adapted to move to a generally horizontal position, providing access to the compartment formed by said spaced panels and means on said hinged side panel adapted to cooperate with said side rails for supporting said hinged side panel in closed position.

2. A device as claimed in claim 1 wherein the means for securing said flanges to said crutch include a bolt extending through said flanges and adapted to be threaded into a receiving socket in the upper end of said leg.

3. A device as claimed in claim 1 wherein the means for securing said hinged side panel in closed position is adapted to cooperate with a magnet secured to one of the side rails of said crutch.

4. A device as claimed in claim 3 wherein said securing means is adapted to cooperate with a second magnet secured to the other of said side rails for assisting and supporting said first named side panel.

5. A device as claimed in claim 4 wherein means are provided on said hinged side panel for supporting a cup.

* * * * *